US007351102B2

(12) United States Patent
Cykon et al.

(10) Patent No.: US 7,351,102 B2
(45) Date of Patent: Apr. 1, 2008

(54) ELECTRICAL CONNECTOR WITH TERMINAL POSITION ASSURANCE

(75) Inventors: James P. Cykon, Warren, OH (US); Amala Garapati Lewis, Canfield, OH (US)

(73) Assignee: Delphi Technologies, Inc., Troy, MI (US)

( * ) Notice: Subject to any disclaimer, the term of this patent is extended or adjusted under 35 U.S.C. 154(b) by 237 days.

(21) Appl. No.: 11/134,646

(22) Filed: May 20, 2005

(65) Prior Publication Data

US 2005/0260869 A1 Nov. 24, 2005

Related U.S. Application Data

(60) Provisional application No. 60/573,178, filed on May 21, 2004.

(51) Int. Cl.
*H01R 13/40* (2006.01)

(52) U.S. Cl. ..... 439/587; 439/595

(58) Field of Classification Search ..... 439/687, 439/70, 485, 364, 358, 587, 595, 752
See application file for complete search history.

(56) References Cited

U.S. PATENT DOCUMENTS 4,944,688 A * 7/1990 Lundergan ..... 439/275
5,520,553 A * 5/1996 Cecil et al. ..... 439/595
5,622,521 A * 4/1997 Marceau et al. ..... 439/595
6,196,872 B1 * 3/2001 Murakami et al. ..... 439/587
6,692,301 B2 * 2/2004 Okayasu et al. ..... 439/587

* cited by examiner

*Primary Examiner*—Michael C. Zarroli
(74) *Attorney, Agent, or Firm*—David P. Wood

(57) ABSTRACT

The present invention provides an electrical connector including a housing defining a receptacle extending to an opening and a cavity block assembly retained in the receptacle. The cavity block assembly includes a base seated in the receptacle and a terminal inserter attached to the base and moveable in a terminal insertion direction from a pre-staged inserter position to a final inserter position. In an exemplary embodiment, a plurality of terminal passages extend in parallel through the base and terminal inserter. When the terminal inserter is in the pre-staged position, terminals may be inserted into the passages to a range of partially inserted positions with respect to the housing or to fully inserted positions. Preferably after all of the terminals are inserted, an urging force is applied to the terminal inserter causing it to move from the pre-staged position to the final position. Simultaneously, the terminal inserter biases any terminal that is located in the range of partially inserted positions to a fully inserted position.

19 Claims, 5 Drawing Sheets

ELECTRICAL CONNECTOR WITH TERMINAL POSITION ASSURANCE

This application claims benefit of priority from U.S. provisional application 60/573,178, filed May 21, 2004, which is hereby incorporated by reference.

TECHNICAL FIELD

This invention relates to electrical connectors, and more particularly to electrical connectors having a member for holding terminals in place in a connector housing.

BACKGROUND OF THE INVENTION

Electrical connectors are widely used to electrically couple conductive elements, such as electrical cables and/or components of devices, to complete an electrical circuit involving those electrical (i.e., conductive) cables and/or components. The use of electrical connectors may be particularly useful where individual electrical cables and/or components are manufactured remotely or at a different time relative to assembly of their host device. In addition to enhancing manufacturability, use of electrical connectors may also enable the subsequent repair, replacement, and/or modification of individual components.

Electrical connectors often facilitate connection of plurality of conductors through a single connector device structure, which may include a corresponding set of terminal cavities for receiving each of the conductors (i.e., conductive terminals) that are typically electrically coupled with one or more electrical cables and/or components. Typically, each of these cavities receives an individual terminal and provides a structure configured so as to electrically and/or electromagnetically isolate the terminals from one another (e.g., to prevent shorting between electrical circuits). A locking structure may also be used to fix the terminals within the cavities. It should be noted that such terminal receiving cavities may be formed in a the housing of a connector or in any other related structure (e.g., a socket insert, grommet, or cavity block) that may be retained within a connector housing. Accordingly, incorporation of such terminal receiving cavities may enable a single housing configuration to accommodate a variety of insert, grommet, and/or cavity block configurations.

Despite the flexibility and other advantages associated with the use of the above-described cavity-defining connector structures, various problems have been encountered in their application and use. For example, it has been discovered that when a first set of terminals, which have been received and fixed in a first set of connector cavities defined in a first connector housing, is mated with a complementary set of terminals, which have been received and fixed in a second set of connector cavities defined in a second connector, one or more of the electrical connections to be made through the electrical connector may not be accomplished or may be accomplished poorly or unreliably due to misalignments, seating failures, introduction of interfering foreign material, or contamination. Such difficulties can then cause defects in the electrical performance of the assembly.

Despite the existence of the above-described problem, current electrical connectors, including known electrical connectors that incorporate a cavity block, fail to provide a mechanism for ensuring the proper (i.e., providing a reliable coupling with satisfactory achievement of expected performance) seating or each of the terminals within a connector housing. In addition, many known connectors fail to provide reliable feedback to the assembler or inspector so as to provide a reliable indication of whether a terminal is fully seated within the housing of the connector. As a result, a terminal may appear to be properly seated and may pass an electrical screening test performed on the connector, but may actually not be fully seated and may later fail in service.

Many of the problems in the prior art relate to failure to properly seat the terminals within an electrical connector. It is recognized that if reliable feedback could be obtained, so as to enable an assembler or inspector to know whether each terminal is properly seated, then appropriate remedial action could be undertaken before a device is placed in service. Accordingly, it would be advantageous to have a means for effectively ensuring that terminals are securely seated (e.g., within a connector housing) and/or for providing an indication when they are not.

SUMMARY OF THE INVENTION

The instant invention seeks to improve the reliability of electrical connections and to minimize the impact of problems inherent in the prior art, including those mentioned above, by providing a means for effectively ensuring that terminals are securely seated (e.g., within a connector housing) and/or for providing an indication when they are not. The present invention provides an electrical connector comprising a housing defining at least one receptacle and a block assembly disposed in the receptacle. In an exemplary embodiment, the block assembly comprises a base seated in the receptacle and a terminal inserter supported by the base. The base and the terminal inserter are mutually configured so as to define a terminal passage extending there-through, and the terminal passage is configured for receiving a terminal along a terminal insertion direction. The terminal inserter is moveable in the terminal insertion direction from a pre-staged inserter position to a final inserter position, and the terminal inserter is configured for urging the terminal into a fully inserted position within the housing.

In an exemplary embodiment, the terminal inserter in accordance with the invention may include at least one biasing element extending into the terminal passage, and the at least one biasing element may be arranged and configured for urging the terminal from a partially inserted position into a fully inserted position. It should be noted that the at least one biasing element may comprise at least one resiliently deflectable terminal lock and the base and the terminal inserter may comprise a mutually-engageable final stage retainer adapted to retain the terminal inserter in the final inserter position. It should also be noted that the base and the terminal inserter may comprise a mutually engageable pre-staged retainer adapted to releasably retain the terminal inserter in the pre-staged inserter position.

In an exemplary embodiment, an electrical connector may include a housing which is configured to define an opening that is positioned to communicate with the receptacle and that is adapted to receive the block assembly. In accordance with this embodiment, the housing may also comprise a retainer configured to interfere with removal of the first block from the receptacle through the opening.

In an exemplary embodiment, the retainer and the housing of an electrical connector in accordance with the invention may be configured to be mutually engageable in both pre-staged and final stage retainer positions, wherein, when the retainer is in the pre-staged retainer position and the terminal inserter is in the pre-staged inserter position, a pre-determined force applied to the retainer in the insertion direction causes the retainer to move to the final stage retainer position and simultaneously cause the terminal inserter to move to the final inserter position. In accordance with this embodiment, the base may comprise at least one second terminal lock arranged so as to inhibit removal of the terminal from the housing through the opening whenever the terminal is disposed in the fully inserted position.

In an exemplary embodiment, an electrical connector comprises a housing defining a receptacle extending to an opening and a first block retained in the receptacle. The first block comprises a biasing element and defines a first cavity. In accordance with this embodiment, the first block is moveable from a pre-staged first block position to a final position, and the biasing element is configured to inhibit removal of a terminal from the housing through the opening. The biasing element may be configured to bias a terminal positioned in the cavity from a pre-staged terminal position into a seated position whenever the first block is in the pre-staged first block position and the terminal is positioned in a pre-staged terminal position. The electrical connector may also comprise a second block seated in the receptacle, and the second block may be configured for retaining the first block. The housing may also comprise a retainer configured for interferingly preventing the first and second blocks from being removed from the receptacle through the opening. In accordance with an exemplary embodiment, a terminal comprises a shoulder engageable with the biasing element, which contacts the shoulder for preventing the terminal from being removed from the housing through the opening. It should be noted that the biasing element may comprise at least one resiliently deflectable first terminal lock.

In another exemplary embodiment, an electrical connector comprises a housing defining a receptacle extending to an opening in a terminal insertion end of the housing, and the housing further defines a plurality of generally parallel first terminal passages extending in an axial direction between the receptacle and openings in a mating end of the housing. In accordance with this embodiment, a block assembly is retained in the receptacle comprises a base seated in the receptacle and a terminal inserter moveably attached to the base and having a pre-staged inserter position and a final inserter position. A plurality of generally parallel second terminal passages extend through the base and terminal inserter, and each one of the second terminal passages is in substantial alignment with a respective one of the first terminal passages. Finally, the terminal inserter comprises at least one first terminal lock extending into each of the second terminal passages. In an exemplary embodiment, an electrical connector may also comprise a retainer attached to the terminal insertion end of the housing and retaining the block assembly in the receptacle.

In an exemplary embodiment, an electrical connector further comprises a seal disposed between the retainer and the terminal inserter. The terminal inserter may comprise a body and a shroud extending from the body, and the shroud may define a space receiving at least a portion of the base. The electrical connector may also comprise a plurality of terminals received in the first terminal passages, and each of the terminals may comprise an elongated body extending in the axial direction and a stop positioned generally transverse to the axial direction. In accordance with this embodiment, each of the first terminal locks engage the stop to prevent the terminals from backing out of the first terminal passages through the second terminal passages. It should be noted that the terminal inserter may be configured to be moveable in a terminal insertion direction from the pre-staged inserter position to the final inserter position. When the terminal inserter is positioned in the pre-staged inserter position and any of the plurality of terminals is initially received within a respective range of partially inserted terminal positions, a movement of the terminal inserter to the final inserter position causes the first terminal locks to contact the stop surfaces and bias each of the terminals initially received within the range of partially inserted terminal positions to a respective fully inserted positions. The base may comprise a plurality of second terminal locks for fixing each of the terminals in a respective fully inserted position. The housing may also comprise a retainer positioned at said terminal insertion end of the housing configured for retaining the block assembly in the receptacle, the retainer defining a plurality of cable passages. The connector may also comprise a plurality of electric cables, each one of said electric cables being attached at one end to a respective one of said terminals and extending from said respective terminal through a respective one of said plurality of cable passages, said retainer providing strain relief to said electric cables.

In an exemplary embodiment of the electrical connector according to the present invention, the terminal inserter includes at least one first terminal lock extending into the terminal passage. In an exemplary embodiment, the terminal inserter is initially positioned in the pre-staged inserter position. In this position, a terminal attached to the end of an electric cable may be inserted into a fully inserted position or a range of partially inserted positions with respect to the housing. Once the terminal is inserted, the terminal inserter is urged in the terminal insertion direction to the final inserter position where the first terminal lock interferingly prevents the terminal from backing out of the fully inserted position. In the event the terminal was initially inserted into the range of partially inserted positions, movement of the terminal inserter from the pre-staged inserter position to the final inserter position causes the first terminal lock to contact a portion of the terminal and bias the terminal to the fully inserted position.

In an exemplary embodiment of the electrical connector, the base includes at least one second terminal lock arranged to interferingly prevent the terminal, when disposed in the fully inserted position, from backing out of the fully inserted position.

In an exemplary embodiment, the base and terminal inserter have mutually engageable final stage retainers adapted to retain the terminal inserter in the final inserter position. In an exemplary embodiment, the base and terminal inserter have mutually engageable pre-stage retainers adapted to releasably retain the terminal inserter in the pre-staged inserter position.

In an exemplary embodiment of the electrical connector, the receptacle extends to an opening adapted to receive the cavity block assembly. In an exemplary embodiment, the electrical connector includes a retainer attached to the housing which interferingly prevents the cavity block assembly from being removed from the receptacle through the opening.

In an exemplary embodiment, the retainer and housing are configured to be mutually engageable so that the retainer has a pre-staged and a final stage retainer position with respect to the housing. In an exemplary embodiment, when the retainer is in the pre-staged retainer position, and the terminal inserter is in the pre-staged inserter position, a predetermined force applied to the retainer in the terminal insertion direction causes the retainer to move to the final stage retainer position and simultaneously causes the terminal inserter to move to the final inserter position.

In an exemplary embodiment, a seal is disposed between the retainer and the terminal inserter. In an exemplary embodiment, at least one cable passageway extends through both the seal and the retainer. In an exemplary embodiment, a terminal attached to an end of a cable is inserted into the housing and the cable extends through the cable passageway. In an exemplary embodiment, the retainer provides strain relief to the cable.

One aspect of the present invention is that an electrical connector is enabled which includes a two-stage locking mechanism enabling terminals to be able to be inserted into a housing of the electrical connector with low terminal insertion force.

Another aspect of the present invention is that the electrical connector includes a terminal inserter which biases any unseated terminals that are located in the range of partially inserted positions to seated positions as the terminal inserter is urged from the pre-staged inserter position to the final inserter position.

Another aspect of the present invention is that an electrical connector is enabled in which both the terminal inserter and the base include terminal locks configured to operate in combination to retain a terminal in a seated position with a high terminal retention force.

And yet another aspect of the present invention is that an electrical connector is enabled in which a terminal is retained a sufficient distance from a seated position so as to enable a consistent determination of a failure in the event such terminal was not initially inserted into either a range of partially inserted positions or a seated position and remained unseated after the terminal inserter was urged from a pre-staged inserter position to a final inserter position.

These and other features and advantages of the present invention will become apparent from the following brief description of the drawings, detailed description, claims, and appended drawings.

BRIEF DESCRIPTION OF THE DRAWINGS

The above-mentioned features and advantages of the present invention can be more clearly understood from the following detailed description considered in conjunction with the following drawings, in which like numerals represent like elements and in which.

DETAILED DESCRIPTION OF THE INVENTION

An electrical connector 10 according to an exemplary embodiment of the present invention will be described below with reference to FIGS. 1-5.

Figure 1:
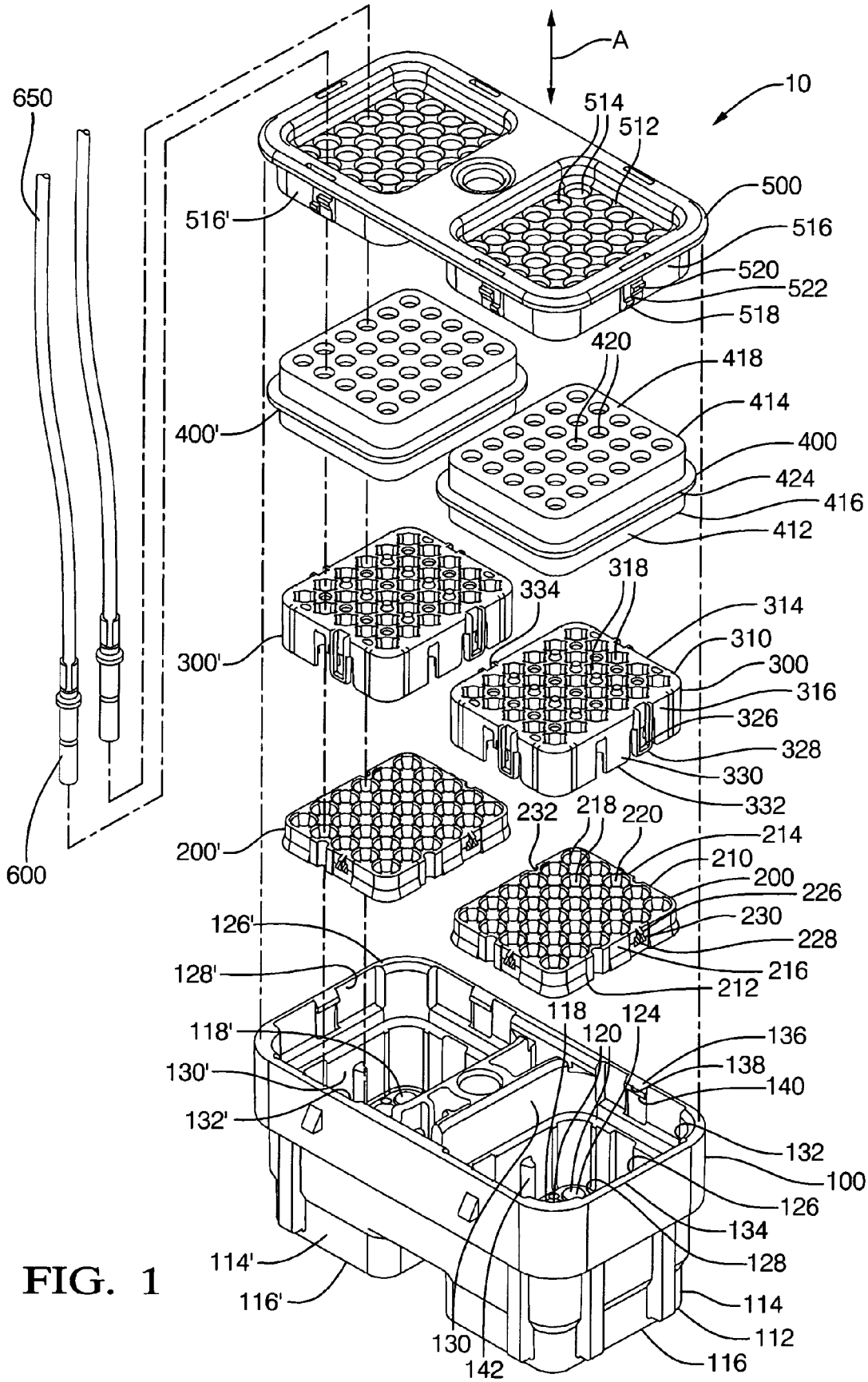
FIG. 1 is an exploded perspective view of an electrical connector according to the present invention.

As shown on FIG. 1, electrical connector 10 includes a housing 100, two identical front cavity block members or bases 200, 200', two identical rear cavity block members or terminal inserters 300, 300', two identical elastomeric seals 400, 400', and a strain relief or retainer 500. Housing 100, bases 200, 200', terminal inserters 300, 300', seals 400, 400', and retainer 500 are adapted to receive a plurality of conductive terminals 600, each terminal 600 being attached to an end of an electric cable 650 (shown on FIGS. 4 and 5).

Housing 100 is preferably composed of an insulative plastic material. A forward end 112 of housing 100 includes two identical transversely spaced forward nose portions 114, 114'. Each nose portion 114, 114' is defined in part by a respective front mating face 116, 116' and a respective rear face 118, 118'. Each nose portion 114, 114' defines a plurality of transversely spaced first terminal cavities or passages 120 arranged in several rows and columns. First terminal passages 120 extend between openings 122, 124 in front face 116, 116' and corresponding rear face 118, 118'. A shroud 126, 126' extends rearwardly from each nose portion 114, 114'. An inside surface 128, 128' of each shroud 126, 126' defines therewithin a respective hollow portion or receptacle 130, 130' extending between each rear face 118, 118' and a respective shroud opening 132, 132' at a rearward terminal insertion end 134 of housing 100. Each first terminal passage 120 extends in parallel with respect to a terminal axis A and communicates with receptacle 130, 130' through opening 124 in rear face 118, 118'. Receptacle 130, 130' is configured to accommodate a respective base 200, 200', terminal inserter 300, 300', and seal 400, 400'. Each shroud opening 132, 132' is configured so that base 200, 200', terminal inserter 300, 300', and seal 400, 400' can be inserted through shroud opening 132, 132' into a corresponding receptacle 130, 130'. A plurality of lock nibs 136 are formed on inside surface 128, 128' of each shroud 126, 126' near terminal insertion end 134. Each lock nib 136 includes a rearward facing ramped pre-stage locking surface 138 and a forward facing final stage locking surface 140. At least one alignment rail 142 protrudes from each inside surface 128, 128'. Alignment rail 142 extends in parallel with respect to terminal axis A.

Base 200 is preferably composed of an insulative plastic material. Base 200 includes a body portion 210 partially defined by a front face 212, a rear face 214, and a side wall portion 216. A plurality of second terminal cavities or passages 218 extend between openings in front and rear faces 212, 214. A pair of resiliently deflectable, cantilevered first terminal lock arms 220 extend forwardly from rear face 214 into mutually opposing portions of each second terminal passage 218. Each first lock arm 220 has a forward facing abutment surface 222 at a distal end 224. When viewed from the front, first lock arms 220 each have an arcuate profile and extend into mutually opposing first and third quadrants (not shown) extending axially through second terminal passage 220. A plurality of pre-stage lock nibs 226 extend outwardly from side wall portion 216 of base 200. A plurality of final stage lock nibs 228 also extend outwardly from side wall portion 216 of base 200. Final stage lock nibs 228 are positioned forward of pre-stage lock nibs 226. Each pre-stage lock nib 226 and a respective proximate final stage lock nib 228 define a slot 230. An alignment groove 232 is formed in side wall portion 216 and extends in parallel with respect to terminal axis A.

Terminal inserter 300 is preferably composed of an insulative plastic material. Inserter 300 includes a body portion 310 partially defined by a front face 312, a rear face 314, and a side wall portion 316. A plurality of third terminal cavities or passages 318 extend between front and rear faces 312, 314. A pair of terminal biasing elements, preferably resiliently deflectable, cantilevered second terminal lock arms 320 extend generally forwardly from front face 312 adjacent mutually opposing portions of a front opening 321 of each third terminal passage 318. Each second lock arm 320 has a forward facing abutment surface 322 at a distal end 324. When viewed from the front, second lock arms 320 each have an arcuate profile and extend into mutually opposing second and fourth quadrants (not shown) extending axially through second terminal passage 220. A plurality of cavity block lock arms 326 extend from side wall portion 316. Each cavity block lock arm 326 includes a lock bar 328. As further described below, each lock bar 328 is adapted to engage pre-stage lock nibs 226 and final stage lock nibs 228 enabling base 200 to retain terminal inserter 300 in pre-staged inserter position 302 and final stage inserter position 304, respectively. A shroud 330 extends forwardly from body portion 310 of terminal inserter 300. Shroud 330 defines a base receiving space 332 configured for receiving at least a portion of base 200. At least one alignment slot 334 is formed in shroud 330 and extends in parallel with respect to terminal axis A.

Seal 400 is preferably composed of an elastic material such as flurosilicone. Seal 400 has a forward portion 412, a rearward portion 414, and a flange 424 disposed between forward and rearward portions 412, 414. Forward portion 412 extends to a front face 416. Rearward portion 414 extends to a rear face 418. A plurality of first cable passageways 420 extend between front and rear faces 416, 418.

Retainer 500 is partially defined by a front face 510 and a rear face 512. A plurality of second cable passageways 514 extend between front and rear faces 510, 512. Two identical shrouds 516, 516' extend forwardly from front face 510. Each shroud 516, 516' is configured to accommodate rearward portion 414 of respective seals 400, 400'. A plurality of pre-stage lock nibs 518 and final stage lock nibs 520 extend outwardly from shroud 516, 516'. Final stage lock nibs 520 are positioned rearwardly from pre-stage lock nibs 518. Each pre-stage lock nib 518 and a respective proximate final stage lock nib 520 define a slot 522. As described in detail below, pre-stage and final stage lock nibs 518, 520 are adapted to engage lock nib 136 of housing 100 to retain retainer 500 in a pre-stage retainer position 502, as shown on FIG. 4, and a final stage 504 retainer position with respect to housing 100, as shown on FIG. 5.

As shown on FIGS. 4 and 5, terminal 600 has a substantially cylindrical, elongated body 610 extending in parallel with respect to terminal axis A when terminal 600 is received in housing 100 as described below. Body 610 has a forward mating portion 612 and a rearward attachment portion 614. A shoulder 616 extends radially outward from body 610. Shoulder 616 includes a forward facing stop surface 618 and a rearward facing stop surface 620. Each stop surface 618, 620 extends in a direction which is nonparallel, and preferably, perpendicular to terminal axis A.

Assembly and operation of electrical connector 10 will now be described.

Base 200 is configured to retain terminal inserter 300 so that base and terminal inserter 200, 300 together form a cavity block assembly 700. Cavity block assembly 700 has a pre-stage configuration 702, as shown on FIGS. 2-4, and a final stage configuration 704, as shown on FIG. 5.

Figure 2:
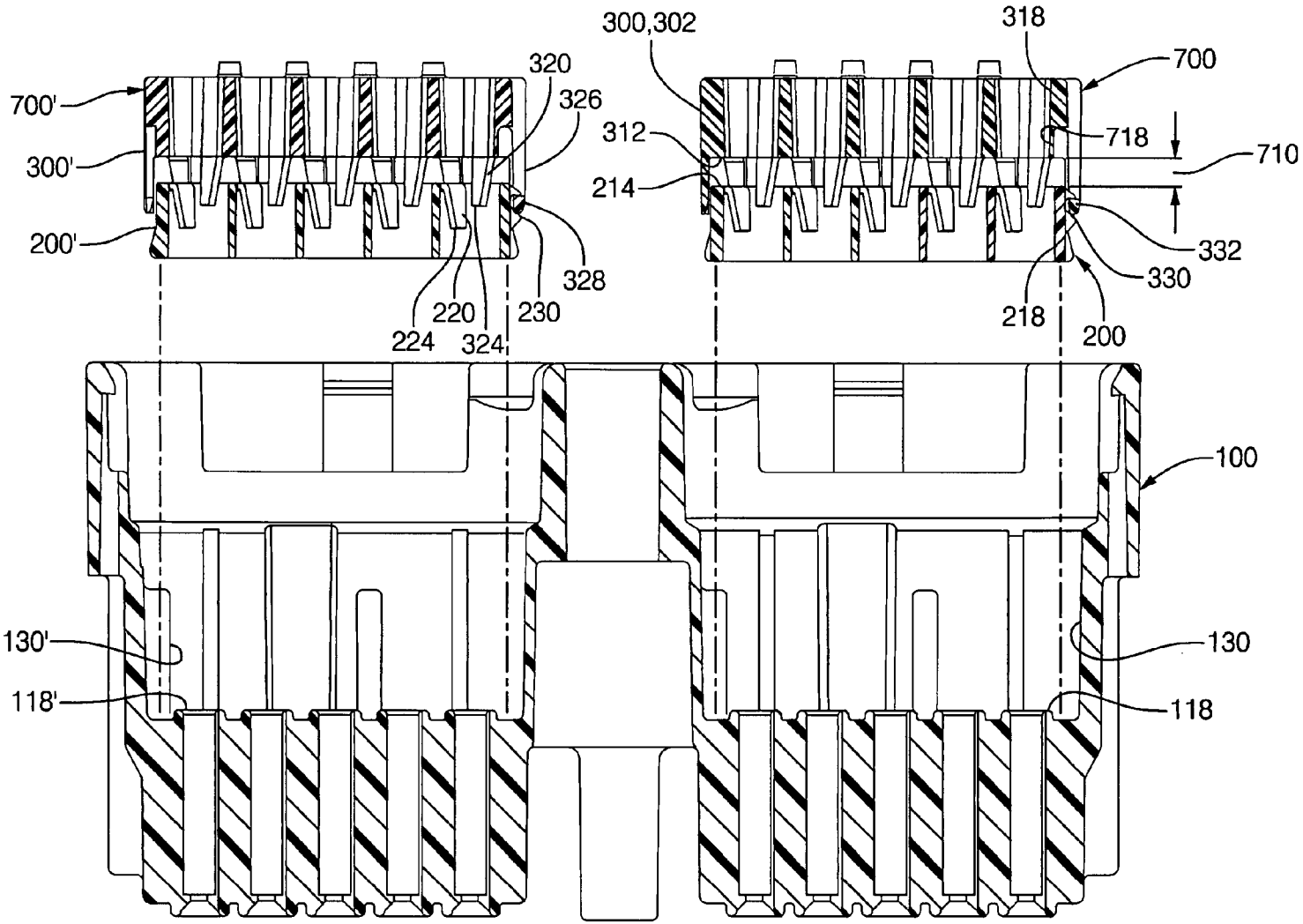
FIG. 2 is a partial sectional view of a first aspect of an electrical connector according to the present invention.

Referring to FIG. 2, two identical cavity block assemblies 700, 700', are initially assembled into pre-stage cavity block configuration 702. In pre-stage cavity block configuration 702, a portion of base 200 extends into base receiving space 332 defined by shroud 330. An axially extending gap 710 exists between front face 312 of terminal inserter 300 and rear face 214 of base 200. Each second terminal passage 218 is aligned with a respective third terminal passage 318 forming a corresponding one of a plurality of fourth terminal passages 718. Each fourth terminal passage 718 extends through cavity block assembly 700, 700' in parallel with axis A. Lock bar 328 of cavity block lock arm 326 is received in slot 230 so that base 200 releasably retains terminal inserter 300 in a pre-stage inserter position 302 with respect to base 200.

Figure 3:
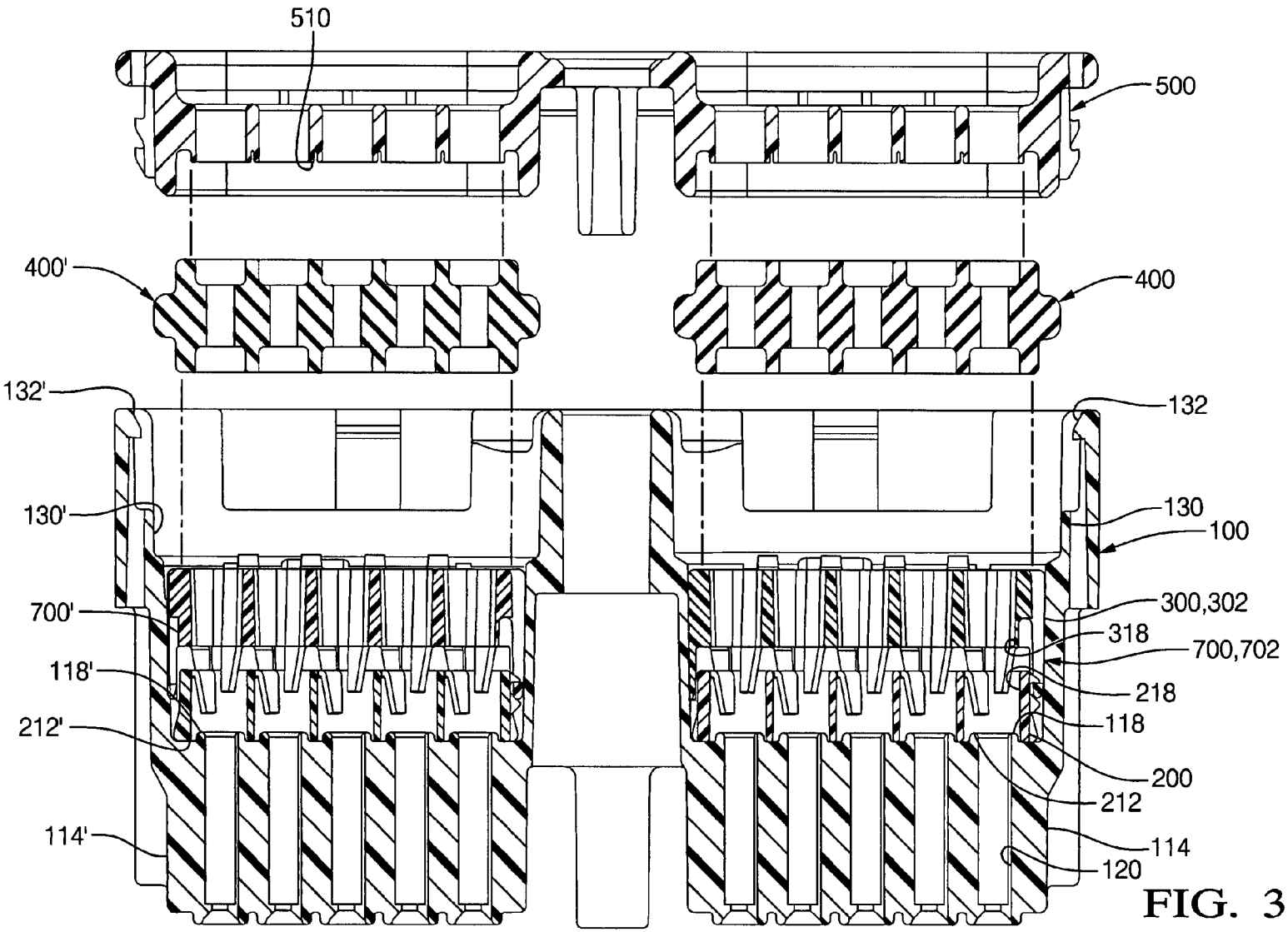
FIG. 3 is a partial sectional view of a second aspect of an electrical connector according to the present invention.

As shown on FIG. 3, each cavity block assembly 700, 700' is configured in pre-stage cavity block configuration 702 and has been inserted into a respective receptacle 130, 130' via a corresponding shroud opening 132, 132'. Each cavity block assembly 700, 700' is seated in a respective receptacle 130, 130' whereby front face 212 of each base 200, 200' abuts a respective rear face 118, 118' of corresponding nose portion 114, 114'. Alignment rail 142 is received in alignment groove 232 and alignment slot 334. First terminal passages 120 align along axis A with corresponding second and third terminal passages 218, 318.

Figure 4:
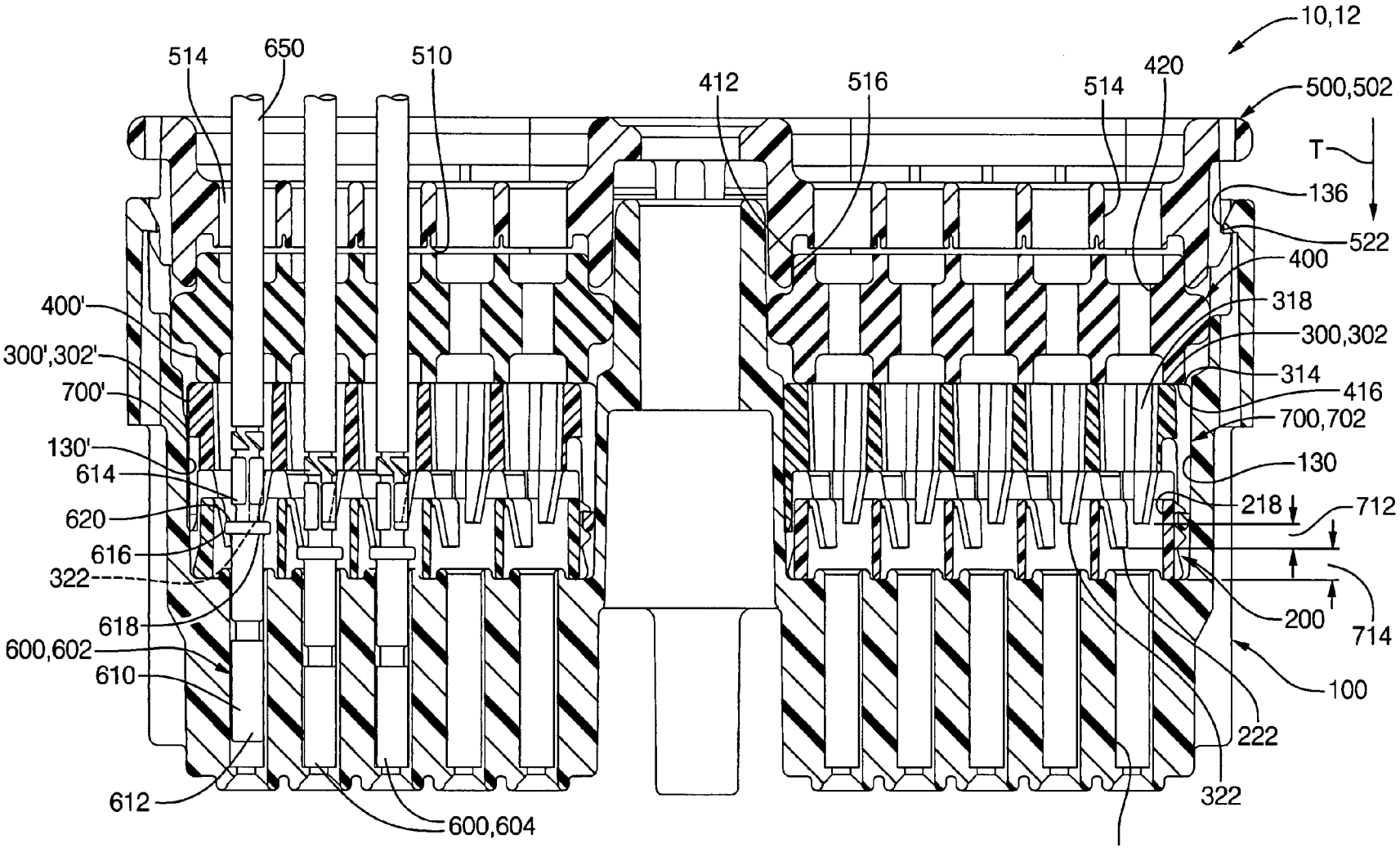
FIG. 4 is a sectional view of an electrical connector according to the present invention configured in a pre-staged configuration.

FIG. 4 illustrates electrical connector 10 in a pre-stage connector configuration 12. In pre-stage connector configuration 12, each cavity block assembly 700, 700' is configured in pre-stage cavity block configuration 702 and seated in respective receptacle 130, 130' as described in detail above. Each seal 400, 400' is received in respective hollow portion 130, 130' and seated on a respective cavity block assembly 700, 700' such that front face 416 of each seal 400, 400' abuts rear face 314 of a respective terminal inserter 300, 300' and each first cable passageway 420 aligns with a corresponding first, second, and third terminal passage 120, 218, 318. Lock nib 136 of housing 100 is received in slot 522 of retainer 500 so that housing 100 releasably retains retainer 500 in pre-stage retainer position 502. Rearward portion 412 of each seal 400, 400' is received in a respective shroud 516, 516' and each first cable passageway 420 aligns with a corresponding second cable passageway 514. Abutment surface 322 on distal end 324 of second lock arm 320 of terminal inserter 300 is spaced a distance, as measured along axis A, from abutment surface 222 on distal end 224 of first lock arm 220 of base 200. An axially extending first space 712 exists between abutment surface 322 of terminal inserter 300 and abutment surface 222 of base 200. First space 712 defines a range for positioning rearward facing stop surface 620 to locate terminal 600 in a range of partially inserted terminal positions 602.

Figure 5:
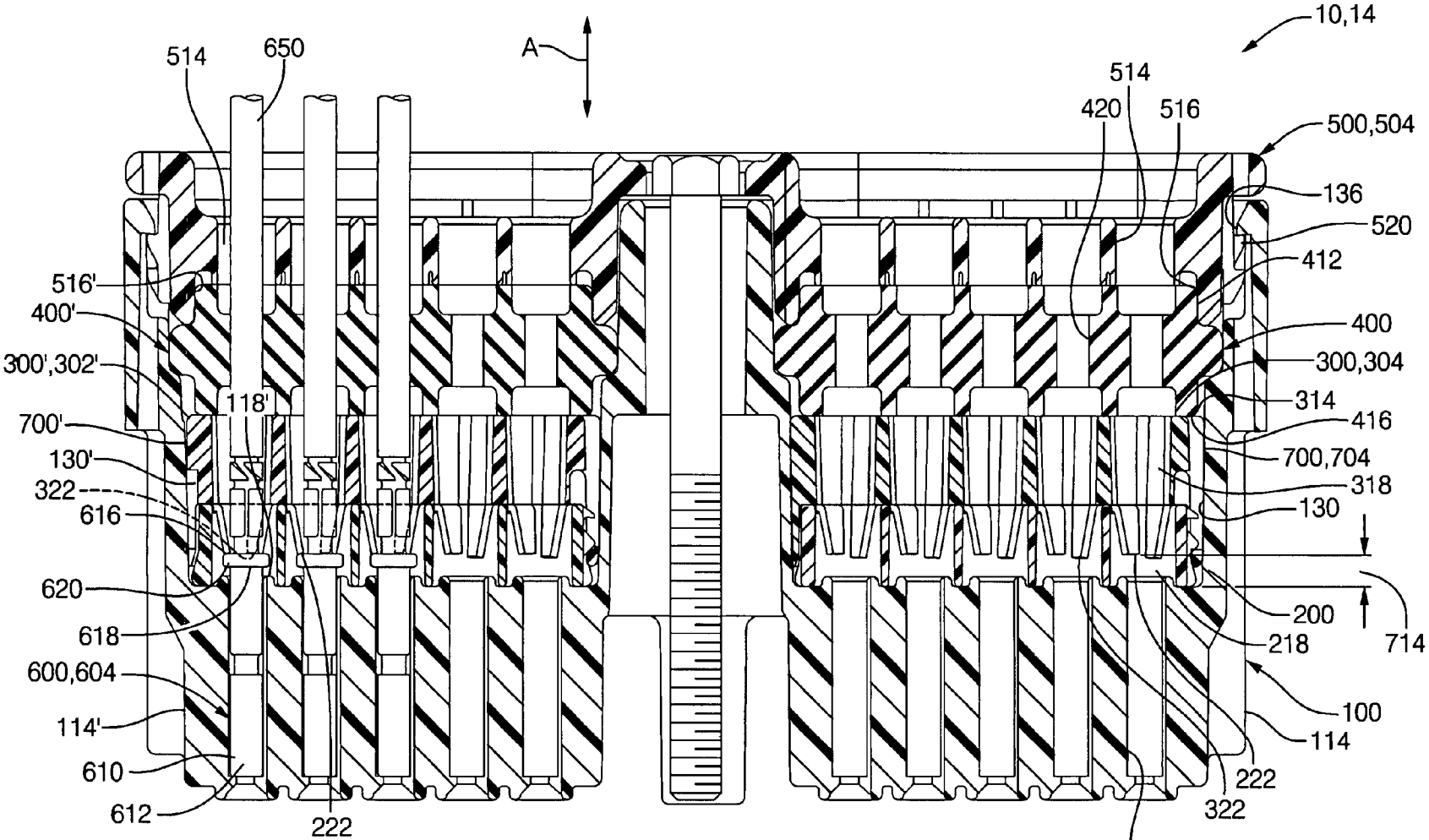
FIG. 5 is a sectional view of an electrical connector according to the present invention configured in a final staged configuration.

Referring now to FIGS. 4-5, insertion of terminals 600 into electrical connector 10 will be further detailed. Preferably, terminals 600 attached to electric cables 650 are initially inserted into shroud opening 132 at rearward end 134 of housing 100 when electrical connector 10 is in pre-stage connector configuration 12 such as shown on FIG. 4. Forward mating portion 612 of terminal 600 may be inserted through second cable passageway 514 of retainer 500 and first cable passageway 418 of seal 400 so that rearward facing stop surface 620 of shoulder 616 is received in first space 712 between abutment surface 322 of terminal inserter 300 and abutment surface 222 of base 200. Terminal 600 is positioned in range of partially inserted terminal positions 602 when stop surface 620 is located in first space 712. When terminal 600 is in range of partially inserted terminal positions 602, abutment surface 322 of second lock arm 320 is configured to contact rearward facing stop surface 620 of terminal 600 to prevent terminal 600 from backing out of housing 100 through shroud opening 132 when a biasing or pulling force is applied to terminal 600.

Terminals 600 may alternately be inserted directly into a fully inserted terminal position or seated position 604 whereby stop surface 620 of terminal 600 is positioned in an axially extending second space 714. Second space 714 extends between abutment surface 222 of front cavity block 224 and rear face 118 of nose portion 114. In this position, forward mating portion 612 extends into first terminal passage 120. Abutment surface 222 of first lock arm 220 is configured to contact rearward facing stop surface 620 of terminal 600 preventing terminal 600 from backing out of fully inserted terminal position 604 when a biasing or pulling force is applied to terminal 600. In addition, nose portion 114 is configured to contact forward facing stop surface 618 preventing terminal 600 from moving forwardly from fully inserted terminal position 604 when a biasing or pulling force is applied to terminal 600.

When terminals 600 are received in range of partially inserted terminal positions 602 (as shown on FIG. 4) and at least a predetermined level of force is applied to retainer 500 in a terminal insertion direction T, retainer 500 moves forwardly from pre-stage retainer position 502 to final retainer position 504 causing lock bar 328 to disengage from slot 230 and terminal inserter 300 to move in terminal insertion direction T from pre-staged inserter position 302 to a final inserter position 304. As terminal inserter 300 moves forwardly from pre-stage inserter position 302, abutment surface 322 of terminal inserter 300 contacts rearward facing stop surface 620 of shoulder 616 biasing terminal 600 from range of partially inserted terminal positions 602 to fully inserted terminal position 604. As shown on FIG. 5, in final stage connector configuration 14, each terminal 600 is retained in fully inserted terminal position 604. In the event that a terminal was not initially inserted to either range of partially inserted terminal positions 602 or fully inserted terminal position 604, such unseated terminal 600 remains a sufficient distance from fully inserted terminal position 604 so as to enable an unseated condition to be easily detected (such as by using an electrical ring-out test).

FIG. 5 illustrates electrical connector 10 in a final stage connector configuration 14. When electrical connector 10 is configured in final stage connector configuration 14 each cavity block assembly 700, 700' is configured in final stage cavity block configuration 704 and seated in respective receptacle 130, 130' as described in detail above. Each seal 400, 400' is received in respective receptacle 130, 130' and seated adjacent respective cavity block assembly 700, 700' such that front face 416 of each seal 400, 400' abuts rear face 314 of respective terminal inserter 300, 300' and each first cable passageway 420 aligns with a corresponding first, second, and third terminal passage 120, 218, 318. Retainer 500 is attached to housing 100 in final stage retainer position 504. In final stage retainer position 504, final stage lock nib 520 of retainer 500 is positioned forward of lock nib 136 of housing 100. Lock nib 136 abuts lock nib 520 affixing retainer 500 to housing 100 in final stage retainer position 504 and retaining each seal 400, 400' and cavity block assembly 700, 700' in respective receptacles 130, 130' of housing 100. Rearward portion 412 of each seal 400, 400' is received in respective shroud 516, 516' and each first cable passageway 420 of each seal 400, 400' aligns with a corresponding second cable passageway 514 of retainer 500.

In fully inserted terminal position 604, terminal 600 is received in first terminal cavity 120 such that shoulder 616 is positioned between rear face 118 of nose portion 114 and abutment surfaces 222, 322 of first and second terminal lock arms 220, 320, respectively. Each nose portion 114, 114' is configured to abut forward facing stop surface 618 to prevent terminal 600 from being removed from housing 100 in a forward direction. Abutment surfaces 222 and 322 of first and second terminal lock arms 220, 320, respectively are configured to abut rearward facing stop surface 620 preventing terminal 600 from being removed from housing 100 in a rearward direction. When viewed from the front, first and second terminal lock arms 220, 320 together form a substantially circular profile with abutment surfaces 222, 322 combining to form a substantially annular terminal locking surface (not shown). An end of an electric cable 650 is attached to rearward attachment portion 614 of each terminal 600 and extends through a respective first cable passageway 420 extending through seal 400, and further extends through a respective second cable passageway 514 extending through retainer 500. Retainer 500 provides strain relief to each electric cable 650.

The preferred embodiments shown and described herein are provided merely by way of example and are not intended to limit the scope of the invention in any way. Preferred dimensions, ratios, materials and construction techniques are illustrative only and are not necessarily required to practice the invention. It is intended that the scope of the present invention herein disclosed should not be limited by the particular disclosed embodiments herein, but should be defined only by a fair reading of the claims that follow.

Having thus described the invention, what is claimed is:

1. An electrical connector comprising:

a housing defining at least one receptacle; and a block assembly disposed in said receptacle, said block assembly comprising a base seated in said receptacle and a terminal inserter supported by said base;

wherein said base and said terminal inserter are mutually configured so as to define a terminal passage extending there-through, said terminal passage being configured for receiving a terminal along a terminal insertion direction, and said terminal inserter being moveable in said terminal insertion direction from a pre-staged inserter position to a final inserter position; and wherein said terminal inserter is configured for urging said terminal into a fully inserted position within said housing;

said terminal inserter comprising at least one biasing element extending into said terminal passage, said at least one biasing element being arranged and configured for urging said terminal from a partially inserted position into a fully inserted position.

2. The electrical connector as recited in claim 1, wherein said at least one biasing element comprises at least one resiliently deflectable terminal lock.

3. The electrical connector as recited in claim 1, wherein said base and said terminal inserter comprise a mutually-engageable final stage retainer adapted to retain said terminal inserter in said final inserter position.

4. The electrical connector as recited in claim 3, wherein said base and said terminal inserter comprise a mutually engageable pre-staged retainer adapted to releasably retain said terminal inserter in said pre-staged inserter position.

5. The electrical connector as recited in claim 1, wherein said housing further defines an opening, said opening being positioned to communicate with said receptacle and adapted to receive said block assembly, said housing further comprising a retainer configured to interfere with removal of said block assembly from said receptacle through said opening.

6. An electrical connector comprising:

a housing defining at least one receptacle; and a block assembly disposed in said receptacle, said block assembly comprising a base seated in said receptacle and a terminal inserter supported by said base;

wherein said base and said terminal inserter are mutually configured so as to define a terminal passage extending there-through, said terminal passage being configured for receiving a terminal along a terminal insertion direction, and said terminal inserter being moveable in said terminal insertion direction from a pre-staged inserter position to a final inserter position;

wherein said terminal inserter is configured for urging said terminal into a fully inserted position within said housing, wherein said housing further defines an opening, said opening being positioned to communicate with said receptacle and adapted to receive said block assembly, said housing further comprising a retainer configured to interfere with removal of said first block from said receptacle through said opening; and wherein said retainer and said housing are configured to be mutually engageable in both pre-staged and final stage retainer positions, wherein, when said retainer is in said pre-staged retainer position and said terminal inserter is in said pre-staged inserter position, a predetermined force applied to said retainer in said insertion direction causes said retainer to move to said final stage retainer position and simultaneously cause said terminal inserter to move to said final inserter position.

7. An electrical connector comprising:

a housing defining at least one receptacle; and a block assembly disposed in said receptacle, said block assembly comprising a base seated in said receptacle and a terminal inserter supported by said base;

wherein said base and said terminal inserter are mutually configured so as to define a terminal passage extending there-through, said terminal passage being configured for receiving a terminal along a terminal insertion direction, and said terminal inserter being moveable in said terminal insertion direction from a pre-staged inserter position to a final inserter position, said terminal inserter comprising at least one biasing element extending into said terminal passage, said at least one biasing element being arranged and configured for urging said terminal along the direction of insertion, wherein said housing further defines an opening, said opening being positioned to communicate with said receptacle and adapted to receive said block assembly, said housing further comprising a retainer configured to interfere with removal of said block assembly from said receptacle through said opening, wherein said base comprises at least one second terminal lock arranged so as to inhibit removal of said terminal from said housing through said opening whenever said terminal is disposed in said fully inserted position.

8. An electrical connector comprising:

a housing defining a receptacle extending to an opening;

a first block retained in said receptacle, said first block comprising a biasing element and defining a first cavity, said first block being moveable from a pre-staged first block position to a final position; and a second block seated in said receptacle, said second block configured for retaining said first block;

wherein said biasing element is configured to inhibit removal of a terminal from said housing through said opening, said biasing element configured to bias a terminal positioned in said cavity from a pre-staged terminal position into a seated position whenever said first block is in said pre-staged first block position and said terminal is positioned in a pre-staged terminal position.

9. The electrical connector as recited in claim 8, said housing further comprising a retainer configured for interferingly preventing said first and second blocks from being removed from said receptacle through said opening.

10. The electrical connector as recited in claim 9, wherein said terminal comprising a shoulder engageable with said biasing element, wherein said biasing element contacts said shoulder for preventing said terminal from being removed from said housing through said opening.

11. The electrical connector as recited in claim 10 wherein said biasing element comprises at least one resiliently deflectable first terminal lock.

12. An electrical connector comprising:

a housing defining a receptacle extending to an opening in a terminal insertion end of said housing, said housing further defining a plurality of generally parallel first terminal passages extending in an axial direction between said receptacle and openings in a mating end of said housing; and a block assembly retained in said receptacle, said block assembly comprising a base seated in said receptacle and a terminal inserter moveably attached to said base and having a pre-staged inserter position and a final inserter position, a plurality of generally parallel second terminal passages extending through said base and terminal inserter, each one of said second terminal passages being in substantial alignment with a respective one of said first terminal passages, said terminal inserter comprising at least one first terminal lock extending into each of said second terminal passages.

13. The electrical connector as recited in claim 12 further comprising a retainer attached to said terminal insertion end of said housing and retaining said block assembly in said receptacle.

14. The electrical connector as recited in claim 13 further comprising a seal disposed between said retainer and said terminal inserter.

15. The electrical connector as recited in claim 12 wherein said terminal inserter comprises a body and a shroud extending from said body, said shroud defining a space receiving at least a portion of said base.

16. The electrical connector as recited in claim 12 further comprising a plurality of terminals received in said first terminal passages, each of said terminals comprising an elongated body extending in said axial direction and a stop positioned generally transverse to said axial direction, each of said first terminal locks engaging said stop to prevent said terminals from backing out of said first terminal passages through said second terminal passages.

17. The electrical connector as recited in claim 16 wherein said terminal inserter is moveable in a terminal insertion direction from said pre-staged inserter position to said final inserter position, wherein when said terminal inserter is positioned in said pre-staged inserter position and in the event any of said plurality of terminals being initially received within a respective range of partially inserted terminal positions, a movement of said terminal inserter to said final inserter position causes said first terminal locks to contact said stop surfaces and bias each of said terminals initially received within said range of partially inserted terminal positions to a respective fully inserted position.

18. The electrical connector as recited in claim 17 wherein said base comprises a plurality of second terminal locks for fixing each of said terminals in said respective fully inserted position.

19. The electrical connector as recited in claim 17, said housing further comprising a retainer positioned at said terminal insertion end of said housing configured for retaining said block assembly in said receptacle, said retainer defining a plurality of cable passages; and a plurality of electric cables, each one of said electric cables being attached at one end to a respective one of said terminals and extending from said respective terminal through a respective one of said plurality of cable passages, said retainer providing strain relief to said electric cables.

* * * * *